US007990336B2

(12) United States Patent
Maines et al.

(10) Patent No.: US 7,990,336 B2
(45) Date of Patent: Aug. 2, 2011

(54) MICROWAVE COUPLED EXCITATION OF SOLID STATE RESONANT ARRAYS

(75) Inventors: Michael Maines, Gainesville, FL (US); Narada Bradman, Gainesville, FL (US); Mark Davidson, Florahome, FL (US)

(73) Assignee: Virgin Islands Microsystems, Inc., Saint Thomas (VG)

( * ) Notice: Subject to any disclaimer, the term of this patent is extended or adjusted under 35 U.S.C. 154(b) by 462 days.

(21) Appl. No.: 12/213,449

(22) Filed: Jun. 19, 2008

(65) Prior Publication Data

US 2009/0072698 A1 Mar. 19, 2009

Related U.S. Application Data

(60) Provisional application No. 60/929,265, filed on Jun. 19, 2007.

(51) Int. Cl.
*H01Q 1/36* (2006.01)

(52) U.S. Cl. ..... 343/895; 343/742

(58) Field of Classification Search ..... 343/895, 343/867, 742; 250/393, 399
See application file for complete search history.

(56) References Cited

U.S. PATENT DOCUMENTS

| | | | |
|---|---|---|---|
| 1,948,384 | A | 2/1934 | Lawrence |
| 2,307,086 | A | 1/1943 | Varian et al. |
| 2,431,396 | A | 11/1947 | Hansell |
| 2,473,477 | A | 6/1949 | Smith |
| 2,634,372 | A | 4/1953 | Salisbury |
| 2,932,798 | A | 4/1960 | Kerst et al. |
| 2,944,183 | A | 7/1960 | Drexler |
| 2,966,611 | A | 12/1960 | Sandstrom |
| 3,231,779 | A | 1/1966 | White |
| 3,274,428 | A | 9/1966 | Neville |
| 3,297,905 | A | 1/1967 | Rockwell et al. |
| 3,315,117 | A | 4/1967 | Udelson |
| 3,387,169 | A | 6/1968 | Farney |
| 3,543,147 | A | 11/1970 | Kovarik |
| 3,546,524 | A | 12/1970 | Stark |
| 3,560,694 | A | 2/1971 | White |
| 3,571,642 | A | 3/1971 | Westcott |
| 3,586,899 | A | 6/1971 | Fleisher |
| 3,761,828 | A | 9/1973 | Pollard et al. |
| 3,886,399 | A | 5/1975 | Symons |
| 3,923,568 | A | 12/1975 | Bersin |
| 3,989,347 | A | 11/1976 | Eschler |

(Continued)

FOREIGN PATENT DOCUMENTS

EP 0237559 B1 12/1991

(Continued)

OTHER PUBLICATIONS

U.S. Appl. No. 11/418,082, filed May 5, 2006, Gorrell et al.

(Continued)

*Primary Examiner* — Tan Ho
(74) *Attorney, Agent, or Firm* — Davidson Berquist Jackson & Gowdey, LLP

(57) ABSTRACT

An electronic receiver array for detecting microwave signals. Ultra-small resonant devices resonate at a frequency higher than the microwave frequency (for example, the optical frequencies) when the microwave energy is incident to the receiver. A microwave antenna couples the microwave energy and excites the ultra-small resonant structures to produce Plasmon activity on the surfaces of the resonant structures. The Plasmon activity produces detectable electromagnetic radiation at the resonant frequency.

20 Claims, 5 Drawing Sheets

U.S. PATENT DOCUMENTS

| | | | |
|---|---|---|---|
| 4,053,845 | A | 10/1977 | Gould |
| 4,269,672 | A | 5/1981 | Inoue |
| 4,282,436 | A | 8/1981 | Kapetanakos |
| 4,296,354 | A | 10/1981 | Neubauer |
| 4,450,554 | A | 5/1984 | Steensma et al. |
| 4,453,108 | A | 6/1984 | Freeman, Jr. |
| 4,482,779 | A | 11/1984 | Anderson |
| 4,528,659 | A | 7/1985 | Jones, Jr. |
| 4,570,103 | A | 2/1986 | Schoen |
| 4,589,107 | A | 5/1986 | Middleton et al. |
| 4,598,397 | A | 7/1986 | Nelson et al. |
| 4,630,262 | A | 12/1986 | Callens et al. |
| 4,652,703 | A | 3/1987 | Lu et al. |
| 4,661,783 | A | 4/1987 | Gover et al. |
| 4,704,583 | A | 11/1987 | Gould |
| 4,712,042 | A | 12/1987 | Hamm |
| 4,713,581 | A | 12/1987 | Haimson |
| 4,727,550 | A | 2/1988 | Chang et al. |
| 4,740,963 | A | 4/1988 | Eckley |
| 4,740,973 | A | 4/1988 | Madey |
| 4,746,201 | A | 5/1988 | Gould |
| 4,761,059 | A | 8/1988 | Yeh et al. |
| 4,782,485 | A | 11/1988 | Gollub |
| 4,789,945 | A | 12/1988 | Niijima |
| 4,806,859 | A | 2/1989 | Hetrick |
| 4,809,271 | A | 2/1989 | Kondo et al. |
| 4,813,040 | A | 3/1989 | Futato |
| 4,819,228 | A | 4/1989 | Baran et al. |
| 4,829,527 | A | 5/1989 | Wortman et al. |
| 4,838,021 | A | 6/1989 | Beattie |
| 4,841,538 | A | 6/1989 | Yanabu et al. |
| 4,864,131 | A | 9/1989 | Rich et al. |
| 4,866,704 | A | 9/1989 | Bergman |
| 4,866,732 | A | 9/1989 | Carey et al. |
| 4,873,715 | A | 10/1989 | Shibata |
| 4,887,265 | A | 12/1989 | Felix |
| 4,890,282 | A | 12/1989 | Lambert et al. |
| 4,898,022 | A | 2/1990 | Yumoto et al. |
| 4,912,705 | A | 3/1990 | Paneth et al. |
| 4,932,022 | A | 6/1990 | Keeney et al. |
| 4,981,371 | A | 1/1991 | Gurak et al. |
| 5,023,563 | A | 6/1991 | Harvey et al. |
| 5,036,513 | A | 7/1991 | Greenblatt |
| 5,065,425 | A | 11/1991 | Lecomte et al. |
| 5,113,141 | A | 5/1992 | Swenson |
| 5,121,385 | A | 6/1992 | Tominaga et al. |
| 5,127,001 | A | 6/1992 | Steagall et al. |
| 5,128,729 | A | 7/1992 | Alonas et al. |
| 5,130,985 | A | 7/1992 | Kondo et al. |
| 5,150,410 | A | 9/1992 | Bertrand |
| 5,155,726 | A | 10/1992 | Spinney et al. |
| 5,157,000 | A | 10/1992 | Elkind et al. |
| 5,163,118 | A | 11/1992 | Lorenzo et al. |
| 5,185,073 | A | 2/1993 | Bindra |
| 5,187,591 | A | 2/1993 | Guy et al. |
| 5,199,918 | A | 4/1993 | Kumar |
| 5,214,650 | A | 5/1993 | Renner et al. |
| 5,233,623 | A | 8/1993 | Chang |
| 5,235,248 | A | 8/1993 | Clark et al. |
| 5,262,656 | A | 11/1993 | Blondeau et al. |
| 5,263,043 | A | 11/1993 | Walsh |
| 5,268,693 | A | 12/1993 | Walsh |
| 5,268,788 | A | 12/1993 | Fox et al. |
| 5,282,197 | A | 1/1994 | Kreitzer |
| 5,283,819 | A | 2/1994 | Glick et al. |
| 5,293,175 | A | 3/1994 | Hemmie et al. |
| 5,302,240 | A | 4/1994 | Hori et al. |
| 5,305,312 | A | 4/1994 | Fornek et al. |
| 5,341,374 | A | 8/1994 | Lewen et al. |
| 5,354,709 | A | 10/1994 | Lorenzo et al. |
| 5,446,814 | A | 8/1995 | Kuo et al. |
| 5,485,277 | A | 1/1996 | Foster |
| 5,504,341 | A | 4/1996 | Glavish |
| 5,578,909 | A | 11/1996 | Billen |
| 5,604,352 | A | 2/1997 | Schuetz |
| 5,608,263 | A | 3/1997 | Drayton et al. |
| 5,637,966 | A | 6/1997 | Umstadter et al. |
| 5,663,971 | A | 9/1997 | Carlsten |
| 5,666,020 | A | 9/1997 | Takemura |
| 5,668,368 | A | 9/1997 | Sakai et al. |
| 5,705,443 | A | 1/1998 | Stauf et al. |
| 5,737,458 | A | 4/1998 | Wojnarowski et al. |
| 5,744,919 | A | 4/1998 | Mishin et al. |
| 5,757,009 | A | 5/1998 | Walstrom |
| 5,767,013 | A | 6/1998 | Park |
| 5,780,970 | A | 7/1998 | Singh et al. |
| 5,790,585 | A | 8/1998 | Walsh |
| 5,811,943 | A | 9/1998 | Mishin et al. |
| 5,821,836 | A | 10/1998 | Katehi et al. |
| 5,821,902 | A | 10/1998 | Keen |
| 5,825,140 | A | 10/1998 | Fujisawa |
| 5,831,270 | A | 11/1998 | Nakasuji |
| 5,847,745 | A | 12/1998 | Shimizu et al. |
| 5,858,799 | A | 1/1999 | Yee et al. |
| 5,889,449 | A | 3/1999 | Fiedziuszko |
| 5,889,797 | A | 3/1999 | Nguyen |
| 5,902,489 | A | 5/1999 | Yasuda et al. |
| 5,963,857 | A | 10/1999 | Greywall |
| 5,972,193 | A | 10/1999 | Chou et al. |
| 6,005,347 | A | 12/1999 | Lee |
| 6,008,496 | A | 12/1999 | Winefordner et al. |
| 6,040,625 | A | 3/2000 | Ip |
| 6,060,833 | A | 5/2000 | Velazco |
| 6,080,529 | A | 6/2000 | Ye et al. |
| 6,117,784 | A | 9/2000 | Uzoh |
| 6,139,760 | A | 10/2000 | Shim et al. |
| 6,180,415 | B1 | 1/2001 | Schultz et al. |
| 6,195,199 | B1 | 2/2001 | Yamada |
| 6,210,555 | B1 | 4/2001 | Taylor et al. |
| 6,222,866 | B1 | 4/2001 | Seko |
| 6,278,239 | B1 | 8/2001 | Caporaso et al. |
| 6,281,769 | B1 | 8/2001 | Fiedziuszko |
| 6,297,511 | B1 | 10/2001 | Syllaios et al. |
| 6,301,041 | B1 | 10/2001 | Yamada |
| 6,303,014 | B1 | 10/2001 | Taylor et al. |
| 6,309,528 | B1 | 10/2001 | Taylor et al. |
| 6,316,876 | B1 | 11/2001 | Tanabe |
| 6,338,968 | B1 | 1/2002 | Hefti |
| 6,370,306 | B1 | 4/2002 | Sato et al. |
| 6,373,194 | B1 | 4/2002 | Small |
| 6,376,258 | B2 | 4/2002 | Hefti |
| 6,407,516 | B1 | 6/2002 | Victor |
| 6,441,298 | B1 | 8/2002 | Thio |
| 6,448,850 | B1 | 9/2002 | Yamada |
| 6,453,087 | B2 | 9/2002 | Frish et al. |
| 6,470,198 | B1 | 10/2002 | Kintaka et al. |
| 6,504,303 | B2 | 1/2003 | Small |
| 6,524,461 | B2 | 2/2003 | Taylor et al. |
| 6,525,477 | B2 | 2/2003 | Small |
| 6,534,766 | B2 | 3/2003 | Abe et al. |
| 6,545,425 | B2 | 4/2003 | Victor |
| 6,552,320 | B1 | 4/2003 | Pan |
| 6,577,040 | B2 | 6/2003 | Nguyen |
| 6,580,075 | B2 | 6/2003 | Kametani et al. |
| 6,603,781 | B1 | 8/2003 | Stinson et al. |
| 6,603,915 | B2 | 8/2003 | Glebov et al. |
| 6,624,916 | B1 | 9/2003 | Green et al. |
| 6,636,185 | B1 | 10/2003 | Spitzer et al. |
| 6,636,534 | B2 | 10/2003 | Madey et al. |
| 6,636,653 | B2 | 10/2003 | Miracky et al. |
| 6,640,023 | B2 | 10/2003 | Miller et al. |
| 6,642,907 | B2 | 11/2003 | Hamada et al. |
| 6,687,034 | B2 | 2/2004 | Wine et al. |
| 6,700,748 | B1 | 3/2004 | Cowles et al. |
| 6,724,486 | B1 | 4/2004 | Shull et al. |
| 6,738,176 | B2 | 5/2004 | Rabinowitz et al. |
| 6,741,781 | B2 | 5/2004 | Furuyama |
| 6,777,244 | B2 | 8/2004 | Pepper et al. |
| 6,782,205 | B2 | 8/2004 | Trisnadi et al. |
| 6,791,438 | B2 | 9/2004 | Takahashi et al. |
| 6,800,877 | B2 | 10/2004 | Victor et al. |
| 6,801,002 | B2 | 10/2004 | Victor et al. |
| 6,808,955 | B2 | 10/2004 | Ma |
| 6,819,432 | B2 | 11/2004 | Pepper et al. |
| 6,829,286 | B1 | 12/2004 | Guilfoyle et al. |
| 6,831,301 | B2 | 12/2004 | Murphy et al. |
| 6,834,152 | B2 | 12/2004 | Gunn et al. |

6,870,438 B1 3/2005 Shino et al.
6,871,025 B2 3/2005 Maleki et al.
6,885,262 B2 4/2005 Nishimura et al.
6,900,447 B2 5/2005 Gerlach et al.
6,908,355 B2 6/2005 Habib et al.
6,909,092 B2 6/2005 Nagahama
6,909,104 B1 6/2005 Koops
6,924,920 B2 8/2005 Zhilkov
6,936,981 B2 8/2005 Gesley
6,943,650 B2 9/2005 Ramprasad et al.
6,952,492 B2 10/2005 Tanaka et al.
6,953,291 B2 10/2005 Liu
6,954,515 B2 10/2005 Bjorkholm et al.
6,944,369 B2 11/2005 Deliwala
6,965,284 B2 11/2005 Maekawa et al.
6,965,625 B2 11/2005 Mross et al.
6,972,439 B1 12/2005 Kim et al.
6,995,406 B2 2/2006 Tojo et al.
7,010,183 B2 3/2006 Estes et al.
7,064,500 B2 6/2006 Victor et al.
7,068,948 B2 6/2006 Wei et al.
7,092,588 B2 8/2006 Kondo
7,092,603 B2 8/2006 Glebov et al.
7,099,586 B2 8/2006 Yoo
7,120,332 B1 10/2006 Spoonhower et al.
7,122,978 B2 10/2006 Nakanishi et al.
7,130,102 B2 10/2006 Rabinowitz
7,177,515 B2 2/2007 Estes et al.
7,194,798 B2 3/2007 Bonhote et al.
7,230,201 B1 6/2007 Miley et al.
7,253,426 B2 8/2007 Gorrell et al.
7,267,459 B2 9/2007 Matheson
7,267,461 B2 9/2007 Kan et al.
7,279,686 B2 10/2007 Schneiker
7,282,776 B2 10/2007 Gorrell
7,309,953 B2 12/2007 Tiberi et al.
7,342,441 B2 3/2008 Gorrell et al.
7,359,589 B2 4/2008 Gorrell et al.
7,361,916 B2 4/2008 Gorrell et al.
7,362,972 B2 4/2008 Yavor et al.
7,375,631 B2 5/2008 Moskowitz et al.
7,397,055 B2 7/2008 Barker et al.
7,408,147 B2 8/2008 Blick et al.
7,436,177 B2 10/2008 Gorrell et al.
7,442,940 B2 10/2008 Gorrell et al.
7,443,358 B2 10/2008 Gorrell et al.
7,459,099 B2 12/2008 Kubena et al.
7,470,920 B2 12/2008 Gorrell et al.
7,473,917 B2 1/2009 Singh
7,498,730 B2 3/2009 Innocenti et al.
7,554,083 B2 6/2009 Gorrell et al.
7,557,365 B2 7/2009 Gorrell et al.
7,557,647 B2 7/2009 Gorrell et al.
7,558,490 B2 7/2009 Gorrell et al.
7,569,836 B2 8/2009 Gorrell
7,573,045 B2 * 8/2009 Gorrell et al. ..... 250/399
7,579,609 B2 8/2009 Gorrell et al.
7,583,370 B2 9/2009 Gorrell et al.
7,586,097 B2 9/2009 Gorrell et al.
7,586,167 B2 9/2009 Gorrell et al.
7,605,835 B2 10/2009 Gorrell
7,619,373 B2 11/2009 Gorrell et al.
7,626,179 B2 12/2009 Gorrell et al.
7,646,991 B2 1/2010 Gorrell et al.
7,656,094 B2 2/2010 Gorrell et al.
7,659,513 B2 2/2010 Gorrell et al.
7,688,274 B2 * 3/2010 Gorrell et al. ..... 343/841
7,710,040 B2 5/2010 Gorrell et al.
7,714,513 B2 5/2010 Gorrell et al.
7,728,397 B2 6/2010 Gorrell et al.
7,728,702 B2 6/2010 Gorrell
7,876,793 B2 1/2011 Gorrell
2001/0002315 A1 5/2001 Schultz et al.
2001/0025925 A1 10/2001 Abe et al.
2001/0045360 A1 11/2001 Omasa
2002/0009723 A1 1/2002 Hefti
2002/0017827 A1 2/2002 Zuppero et al.
2002/0027481 A1 3/2002 Fiedziuszko
2002/0036121 A1 3/2002 Ball et al.
2002/0036264 A1 3/2002 Nakasuji et al.
2002/0053638 A1 5/2002 Winkler et al.
2002/0056645 A1 5/2002 Taylor et al.
2002/0068018 A1 6/2002 Pepper et al.
2002/0070671 A1 6/2002 Small
2002/0071457 A1 6/2002 Hogan
2002/0122531 A1 9/2002 Whitham
2002/0135665 A1 9/2002 Gardner
2002/0139961 A1 10/2002 Kinoshita et al.
2002/0158295 A1 10/2002 Armgarth et al.
2002/0191650 A1 12/2002 Madey et al.
2003/0010979 A1 1/2003 Pardo
2003/0012925 A1 1/2003 Gorrell
2003/0016412 A1 1/2003 Small
2003/0016421 A1 1/2003 Small
2003/0034535 A1 2/2003 Barenburg et al.
2003/0103150 A1 6/2003 Catrysse et al.
2003/0106998 A1 6/2003 Colbert et al.
2003/0127944 A1 7/2003 Clark et al.
2003/0155521 A1 8/2003 Feuerbaum
2003/0158474 A1 8/2003 Scherer et al.
2003/0164947 A1 9/2003 Vaupel
2003/0179974 A1 9/2003 Estes et al.
2003/0206708 A1 11/2003 Estes et al.
2003/0214695 A1 11/2003 Abramson et al.
2003/0222579 A1 12/2003 Habib et al.
2004/0011432 A1 1/2004 Podlaha et al.
2004/0061053 A1 4/2004 Taniguchi et al.
2004/0080285 A1 4/2004 Victor et al.
2004/0085159 A1 5/2004 Kubena et al.
2004/0092104 A1 5/2004 Gunn, III et al.
2004/0108471 A1 6/2004 Luo et al.
2004/0108473 A1 6/2004 Melnychuk et al.
2004/0108823 A1 6/2004 Amaldi et al.
2004/0114854 A1 6/2004 Ouchi
2004/0136715 A1 7/2004 Kondo
2004/0150991 A1 8/2004 Ouderkirk et al.
2004/0154925 A1 8/2004 Podlaha et al.
2004/0171272 A1 9/2004 Jin et al.
2004/0180244 A1 9/2004 Tour et al.
2004/0184270 A1 9/2004 Halter
2004/0213375 A1 10/2004 Bjorkholm et al.
2004/0217297 A1 11/2004 Moses et al.
2004/0218651 A1 11/2004 Iwasaki et al.
2004/0231996 A1 11/2004 Webb
2004/0240035 A1 12/2004 Zhilkov
2004/0264867 A1 12/2004 Kondo
2005/0023145 A1 2/2005 Cohen et al.
2005/0045821 A1 3/2005 Noji et al.
2005/0045832 A1 3/2005 Kelly et al.
2005/0054151 A1 3/2005 Lowther et al.
2005/0062903 A1 3/2005 Cok et al.
2005/0067286 A1 3/2005 Ahn et al.
2005/0082469 A1 4/2005 Carlo
2005/0092929 A1 5/2005 Schneiker
2005/0104684 A1 5/2005 Wojcik
2005/0105595 A1 5/2005 Martin et al.
2005/0105690 A1 5/2005 Pau et al.
2005/0145882 A1 7/2005 Taylor et al.
2005/0152635 A1 7/2005 Paddon et al.
2005/0162104 A1 7/2005 Victor et al.
2005/0180678 A1 8/2005 Panepucci et al.
2005/0190637 A1 9/2005 Ichimura et al.
2005/0191055 A1 9/2005 Maruyama et al.
2005/0194258 A1 9/2005 Cohen et al.
2005/0201707 A1 9/2005 Glebov et al.
2005/0201717 A1 9/2005 Matsumura et al.
2005/0206314 A1 9/2005 Habib et al.
2005/0212503 A1 9/2005 Deibele
2005/0230822 A1 10/2005 Tran
2005/0231138 A1 10/2005 Nakanishi et al.
2005/0231855 A1 10/2005 Tran
2005/0249451 A1 11/2005 Baehr-Jones et al.
2005/0285541 A1 12/2005 LeChevalier
2006/0007730 A1 1/2006 Nakamura et al.
2006/0018619 A1 1/2006 Helffrich et al.
2006/0023991 A1 2/2006 Okubora
2006/0035173 A1 2/2006 Davidson et al.
2006/0045418 A1 3/2006 Cho et al.

| | | | | |
|---|---|---|---|---|
| 2006/0050269 | A1 | 3/2006 | Brownell | |
| 2006/0060782 | A1 | 3/2006 | Khursheed | |
| 2006/0062258 | A1 | 3/2006 | Brau et al. | |
| 2006/0131176 | A1 | 6/2006 | Hsu | |
| 2006/0131695 | A1 | 6/2006 | Kuekes et al. | |
| 2006/0159131 | A1 | 7/2006 | Liu et al. | |
| 2006/0164496 | A1 | 7/2006 | Tokutake et al. | |
| 2006/0187794 | A1 | 8/2006 | Harvey et al. | |
| 2006/0208667 | A1 | 9/2006 | Lys et al. | |
| 2006/0216940 | A1 | 9/2006 | Gorrell et al. | |
| 2006/0232364 | A1 | 10/2006 | Koh et al. | |
| 2006/0243925 | A1 | 11/2006 | Barker et al. | |
| 2006/0260674 | A1 | 11/2006 | Tran | |
| 2006/0274922 | A1 | 12/2006 | Ragsdale | |
| 2007/0003781 | A1 | 1/2007 | de Rochemont | |
| 2007/0013765 | A1 | 1/2007 | Hudson et al. | |
| 2007/0034518 | A1 | 2/2007 | Gorrell et al. | |
| 2007/0075263 | A1 | 4/2007 | Gorrell et al. | |
| 2007/0075264 | A1 | 4/2007 | Gorrell et al. | |
| 2007/0075907 | A1 | 4/2007 | Gorrell et al. | |
| 2007/0085039 | A1 | 4/2007 | Gorrell et al. | |
| 2007/0086915 | A1 | 4/2007 | LeBoeuf et al. | |
| 2007/0116420 | A1 | 5/2007 | Estes et al. | |
| 2007/0146704 | A1 | 6/2007 | Schmidt et al. | |
| 2007/0152176 | A1 | 7/2007 | Gorrell et al. | |
| 2007/0154846 | A1 | 7/2007 | Gorrell et al. | |
| 2007/0170370 | A1 | 7/2007 | Gorrell et al. | |
| 2007/0194357 | A1 | 8/2007 | Oohashi | |
| 2007/0200646 | A1 | 8/2007 | Gorrell et al. | |
| 2007/0200940 | A1 | 8/2007 | Gruhlke et al. | |
| 2007/0238037 | A1 | 10/2007 | Wuister et al. | |
| 2007/0252983 | A1 | 11/2007 | Tong et al. | |
| 2007/0257619 | A1 | 11/2007 | Gorrell et al. | |
| 2007/0258492 | A1 | 11/2007 | Gorrell | |
| 2007/0258675 | A1 | 11/2007 | Gorrell et al. | |
| 2007/0258689 | A1 | 11/2007 | Gorrell et al. | |
| 2007/0258690 | A1 | 11/2007 | Gorrell et al. | |
| 2007/0258720 | A1 | 11/2007 | Gorrell et al. | |
| 2007/0259488 | A1 | 11/2007 | Gorrell et al. | |
| 2007/0259641 | A1 | 11/2007 | Gorrell et al. | |
| 2007/0264023 | A1 | 11/2007 | Gorrell et al. | |
| 2007/0264030 | A1 | 11/2007 | Gorrell et al. | |
| 2007/0282030 | A1 | 12/2007 | Anderson et al. | |
| 2007/0284527 | A1 | 12/2007 | Zani et al. | |
| 2007/0297740 | A1 | 12/2007 | Zhou | |
| 2008/0069509 | A1 | 3/2008 | Gorrell et al. | |
| 2008/0083881 | A1* | 4/2008 | Gorrell et al. | 250/399 |
| 2008/0218102 | A1 | 9/2008 | Sliski et al. | |
| 2008/0283501 | A1 | 11/2008 | Roy | |
| 2008/0302963 | A1 | 12/2008 | Nakasuji et al. | |
| 2009/0027280 | A1 | 1/2009 | Frangioni et al. | |
| 2009/0230332 | A1 | 9/2009 | Buttrill | |

FOREIGN PATENT DOCUMENTS

| | | | |
|---|---|---|---|
| JP | 2004-32323 | A | 1/2004 |
| WO | WO 87/01873 | | 3/1987 |
| WO | WO 93/21663 | A1 | 10/1993 |
| WO | WO 98/21788 | | 5/1998 |
| WO | WO 00/72413 | | 11/2000 |
| WO | WO 02/25785 | | 3/2002 |
| WO | WO 02/077607 | | 10/2002 |
| WO | WO 2004/086560 | | 10/2004 |
| WO | WO 2005/015143 | A2 | 2/2005 |
| WO | WO 2005/098966 | | 10/2005 |
| WO | WO 2006/042239 | A2 | 4/2006 |
| WO | WO 2007/081389 | | 7/2007 |
| WO | WO 2007/081390 | | 7/2007 |
| WO | WO 2007/081391 | | 7/2007 |

OTHER PUBLICATIONS

"An Early History—Invention of the Klystron," http://varianinc.com/cgi-bin/advprint/print.cgi?cid=KLQNPPJJFJ, printed on Dec. 26, 2008.

"An Early History—The Founding of Varian Associates," http://varianinc.com/cgi-bin/advprint/print.cgi?cid=KLQNPPJJFJ, printed on Dec. 26, 2008.

"Array of Nanoklystrons for Frequency Agility or Redundancy," NASA's Jet Propulsion Laboratory, NASA Tech Briefs, NPO-21033. 2001.

"Chapter 3 X-Ray Tube," http://compepid.tuskegee.edu/syllabi/clinical/small/radiology/chapter..., printed from tuskegee.edu on Dec. 29, 2008.

"Diagnostic imaging modalities—Ionizing vs non-ionizing radiation," http://info.med.yale.edu/intmed/cardio/imaging/techniques/ionizing$_{13}$ v..., printed from Yale University School of Medicine on Dec. 29, 2008.

"Frequently Asked Questions," Luxtera Inc., found at http://www.luxtera.com/technology_faq.htm, printed on Dec. 2, 2005, 4 pages.

"Hardware Development Programs," Calabazas Creek Research, Inc. found at http://calcreek.com/hardware.html.

"Klystron Amplifier," http://www.radartutorial.eu/08.transmitters/tx12.en.html, printed on Dec. 26, 2008.

"Klystron is a Micowave Generator," http://www2.slac.stanford.edu/vvc/accelerators/klystron.html, printed on Dec. 26, 2008.

"Klystron," http:en.wikipedia.org/wiki/Klystron, printed on Dec. 26, 2008.

"Making X-rays," http://www.fnrfscience.cmu.ac.th/theory/radiation/xray-basics.html, printed on Dec. 29, 2008.

"Microwave Tubes," http://www.tpub.com/neets/book11/45b.htm, printed on Dec. 26, 2008.

"Notice of Allowability" mailed on Jan. 17, 2008 in U.S. Appl. No. 11/418,082, filed May 5, 2006.

"Technology Overview," Luxtera, Inc., found at http://www.luxtera.com/technology.htm, printed on Dec. 2, 2005, 1 page.

"The Reflex Klystron," http://www.fnrfscience.cmu.ac.th/theory/microwave/microwave%2, printed from Fast Netoron Research Facilty on Dec. 26, 2008.

"x-ray tube," http://www.answers.com/topic/x-ray-tube, printed on Dec. 29, 2008.

"Antenna Arrays." May 18, 2002. www.tpub.com/content/neets/14183/css/14183_159.htm.

"Diffraction Grating," hyperphysics.phy-astr.gsu.edu/hbase/phyopt/grating.html.

Mar. 24, 2006 PTO Office Action in U.S. Appl. No. 10/917,511.

Mar. 25, 2008 PTO Office Action in U.S. Appl. No. 11/411,131.

Apr. 8, 2008 PTO Office Action in U.S. Appl. No. 11/325,571.

Apr. 17, 2008 Response to PTO Office Action of Dec. 20, 2007 in U.S. Appl. No. 11/418,087.

Apr. 19, 2007 Response to PTO Office Action of Jan. 17, 2007 in U.S. Appl. No. 11/418,082.

May 10, 2005 PTO Office Action in U.S. Appl. No. 10/917,511.

May 21, 2007 PTO Office Action in U.S. Appl. No. 11/418,087.

May 26, 2006 Response to PTO Office Action of Mar. 24, 2006 in U.S. Appl. No. 10/917,511.

Jun. 16, 2008 Response to PTO Office Action of Dec. 14, 2007 in U.S. Appl. No. 11/418,264.

Jun. 20, 2008 Response to PTO Office Action of Mar. 25, 2008 in U.S. Appl. No. 11/411,131.

Aug. 14, 2006 PTO Office Action in U.S. Appl. No. 10/917,511.

Sep. 1, 2006 Response to PTO Office Action of Aug. 14, 2006 in U.S. Appl. No. 10/917,511.

Sep. 12, 2005 Response to PTO Office Action of May 10, 2005 in U.S. Appl. No. 10/917,511.

Sep. 14, 2007 PTO Office Action in U.S. Appl. No. 11/411,131.

Oct. 19, 2007 Response to PTO Office Action of May 21, 2007 in U.S. Appl. No. 11/418,087.

Dec. 4, 2006 PTO Office Action in U.S. Appl. No. 11/418,087.

Dec. 14, 2007 PTO Office Action in U.S. Appl. No. 11/418,264.

Dec. 14, 2007 Response to PTO Office Action of Sep. 14, 2007 in U.S. Appl. No. 11/411,131.

Dec. 20, 2007 PTO Office Action in U.S. Appl. No. 11/418,087.

Alford, T.L. et al., "Advanced silver-based metallization patterning for ULSI applications," Microelectronic Engineering 55, 2001, pp. 383-388, Elsevier Science B.V.

Amato, Ivan, "An Everyman's Free-Electron Laser?" Science, New Series, Oct. 16, 1992, p. 401, vol. 258 No. 5081, American Association for the Advancement of Science.

Andrews, H.L. et al., "Dispersion and Attenuation in a Smith-Purcell Free Electron Laser," The American Physical Society, Physical Review Special Topics—Accelerators and Beams 8 (2005), pp. 050703-1-050703-9.
Backe, H. et al. "Investigation of Far-Infrared Smith-Purcell Radiation at the 3.41 MeV Electron Injector Linac of the Mainz Microtron MAMI," Institut fur Kernphysik, Universitat Mainz, D-55099, Mainz Germany.
Bakhtyari, A. et al., "Horn Resonator Boosts Miniature Free-Electron Laser Power," Applied Physics Letters, May 12, 2003, pp. 3150-3152, vol. 82, No. 19, American Institute of Physics.
Bakhtyari, Dr. Arash, "Gain Mechanism in a Smith-Purcell MicroFEL," Abstract, Department of Physics and Astronomy, Dartmouth College.
Bhattacharjee, Sudeep et al., "Folded Waveguide Traveling-Wave Tube Sources for Terahertz Radiation." IEEE Transactions on Plasma Science, vol. 32. No. 3, Jun. 2004, pp. 1002-1014.
Booske, J.H. et al., "Microfabricated TWTs as High Power, Wideband Sources of THz Radiation".
Brau, C.A. et al., "Gain and Coherent Radiation from a Smith-Purcell Free Electron Laser," Proceedings of the 2004 FEL Conference, pp. 278-281.
Brownell, J.H. et al., "Improved μFEL Performance with Novel Resonator," Jan. 7, 2005, from website: www.frascati.enea.it/thz-bridge/workshop/presentations/Wednesday/We-07-Brownell.ppt.
Brownell, J.H. et al., "The Angular Distribution of the Power Produced by Smith-Purcell Radiation," J. Phys. D: Appl. Phys. 1997, pp. 2478-2481, vol. 30, IOP Publishing Ltd., United Kingdom.
Chuang, S.L. et al., "Enhancement of Smith-Purcell Radiation from a Grating with Surface-Plasmon Excitation," Journal of the Optical Society of America, Jun. 1984, pp. 672-676, vol. 1 No. 6, Optical Society of America.
Chuang, S.L. et al., "Smith-Purcell Radiation from a Charge Moving Above a Penetrable Grating," IEEE MTT-S Digest, 1983, pp. 405-406, IEEE.
Corcoran, Elizabeth, "Ride the Light," Forbes Magazine, Apr. 11, 2005, pp. 68-70.
European Search Report mailed Mar. 3, 2009 in European Application No. 06852028.7.
Far-IR, Sub-MM & MM Detector Technology Workshop list of manuscripts, session 6 2002.
Feltz, W.F. et al., "Near-Continuous Profiling of Temperature, Moisture, and Atmospheric Stability Using the Atmospheric Emitted Radiance Interferometer (AERI)," Journal of Applied Meteorology, May 2003, vol. 42 No. 5, H.W. Wilson Company, pp. 584-597.
Freund, H.P. et al., "Linearized Field Theory of a Smith-Purcell Traveling Wave Tube," IEEE Transactions on Plasma Science, Jun. 2004, pp. 1015-1027, vol. 32 No. 3, IEEE.
Gallerano, G.P. et al., "Overview of Terahertz Radiation Sources," Proceedings of the 2004 FEL Conference, pp. 216-221.
Goldstein, M. et al., "Demonstration of a Micro Far-Infrared Smith-Purcell Emitter," Applied Physics Letters, Jul. 28, 1997, pp. 452-454, vol. 71 No. 4, American Institute of Physics.
Gover, A. et al., "Angular Radiation Pattern of Smith-Purcell Radiation," Journal of the Optical Society of America, Oct. 1984, pp. 723-728, vol. 1 No. 5, Optical Society of America.
Grishin, Yu. A. et al., "Pulsed Orotron—A New Microwave Source for Submillimeter Pulse High-Field Electron Paramagnetic Resonance Spectroscopy," Review of Scientific Instruments, Sep. 2004, pp. 2926-2936, vol. 75 No. 9, American Institute of Physics.
International Search Report and Written Opinion mailed Nov. 23, 2007 in International Application No. PCT/US2006/022786.
Ishizuka, H. et al., "Smith-Purcell Experiment Utilizing a Field-Emitter Array Cathode: Measurements of Radiation," Nuclear Instruments and Methods in Physics Research, 2001, pp. 593-598, A 475, Elsevier Science B.V.
Ishizuka, H. et al., "Smith-Purcell Radiation Experiment Using a Field-Emission Array Cathode," Nuclear Instruments and Methods in Physics Research, 2000, pp. 276-280, A 445, Elsevier Science B.V.
Ives, Lawrence et al., "Development of Backward Wave Oscillators for Terahertz Applications," Terahertz for Military and Security Applications, Proceedings of SPIE vol. 5070 (2003), pp. 71-82.
Ives, R. Lawrence, "IVEC Summary, Session 2, Sources I" 2002.
J. C. Palais, "Fiber optic communications," Prentice Hall, New Jersey, 1998, pp. 156-158.
Jonietz, Erika, "Nano Antenna Gold nanospheres show path to all-optical computing," Technology Review, Dec. 2005/Jan. 2006, p. 32.
Joo, Youngcheol et al., "Air Cooling of IC Chip with Novel Microchannels Monolithically Formed on Chip Front Surface," Cooling and Thermal Design of Electronic Systems (HTD-vol. 319 & EEP-vol. 15), International Mechanical Engineering Congress and Exposition, San Francisco, CA, Nov. 1995, pp. 117-121.
Joo, Youngcheol et al., "Fabrication of Monolithic Microchannels for IC Chip Cooling," 1995, Mechanical, Aerospace and Nuclear Engineering Department, University of California at Los Angeles.
Jung, K.B. et al., "Patterning of Cu, Co, Fe, and Ag for magnetic nanostructures," J. Vac. Sci. Technol. A 15(3), May/Jun. 1997, pp. 1780-1784.
Kapp, Oscar H. et al., "Modification of a Scanning Electron Microscope to Produce Smith-Purcell Radiation," Review of Scientific Instruments, Nov. 2004, pp. 4732-4741, vol. 75 No. 11, American Institute of Physics.
Kiener, C. et al., "Investigation of the Mean Free Path of Hot Electrons in GaAs/AlGaAs Heterostructures," Semicond. Sci. Technol., 1994, pp. 193-197, vol. 9, IOP Publishing Ltd., United Kingdom.
Kim, Shang Hoon, "Quantum Mechanical Theory of Free-Electron Two-Quantum Stark Emission Driven by Transverse Motion," Journal of the Physical Society of Japan, Aug. 1993, vol. 62 No. 8, pp. 2528-2532.
Korbly, S.E. et al., "Progress on a Smith-Purcell Radiation Bunch Length Diagnostic," Plasma Science and Fusion Center, MIT, Cambridge, MA.
Kormann, T. et al., "A Photoelectron Source for the Study of Smith-Purcell Radiation".
Kube, G. et al., "Observation of Optical Smith-Purcell Radiation at an Electron Beam Energy of 855 MeV," Physical Review E, May 8, 2002, vol. 65, The American Physical Society, pp. 056501-1-056501-15.
Lee Kwang-Cheol et al., "Deep X-Ray Mask with Integrated Actuator for 3D Microfabrication", Conference: Pacific Rim Workshop on Transducers and Micro/Nano Technologies, (Xiamen CHN), Jul. 22, 2002.
Liu, Chuan Sheng, et al., "Stimulated Coherent Smith-Purcell Radiation from a Metallic Grating," IEEE Journal of Quantum Electronics, Oct. 1999, pp. 1386-1389, vol. 35, No. 10, IEEE.
Manohara, Harish et al., "Field Emission Testing of Carbon Nanotubes for THz Frequency Vacuum Microtube Sources." Abstract. Dec. 2003. from SPIEWeb.
Manohara, Harish M. et al., "Design and Fabrication of a THz Nanoklystron".
Manohara, Harish M. et al., "Design and Fabrication of a THz Nanoklystron" (www.sofia.usra.edu/det_workshop/ posters/session 3/3-43manohara_poster.pdf), PowerPoint Presentation.
Markoff, John, "A Chip That Can Transfer Data Using Laser Light," The New York Times, Sep. 18, 2006.
McDaniel, James C. et al, "Smith-Purcell Radiation in the High Conductivity and Plasma Frequency Limits," Applied Optics, Nov. 15, 1989, pp. 4924-4929, vol. 28 No. 22, Optical Society of America.
Meyer, Stephan, "Far IR, Sub-MM & MM Detector Technology Workshop Summary," Oct. 2002. (may date the Manohara documents).
Mokhoff, Nicolas, "Optical-speed light detector promises fast space talk," EETimes Online, Mar. 20, 2006, from website: www.eetimes.com/showArticle.jhtml?articleID=183701047.
Neo et al., "Smith-Purcell Radiation from Ultraviolet to Infrared Using a Si-field Emitter" Vacuum Electronics Conference, 2007, IVEC '07, IEEE International May 2007.
Nguyen, Phucanh et al., "Novel technique to pattern silver using CF4 and CF4/O2 glow discharges," J.Vac. Sci. Technol. B 19(1), Jan./Feb. 2001, American Vacuum Society, pp. 158-165.
Nguyen, Phucanh et al., "Reactive ion etch of patterned and blanket silver thin films in CI2/O2 and O2 glow discharges," J. Vac. Sci, Technol. B. 17(5), Sep./Oct. 1999, American Vacuum Society, pp. 2204-2209.

Ohtaka, Kazuo, "Smith-Purcell Radiation from Metallic and Dielectric Photonic Crystals," Center for Frontier Science, pp. 272-273, Chiba University, 1-33 Yayoi, Inage-ku, Chiba-shi, Japan.
Ossia, Babak, "The X-Ray Production," Department of Biomedical Engineering—University of Rhode Island, 1 page.
Phototonics Research, "Surface-Plasmon-Enhanced Random Laser Demonstrated," Phototonics Spectra, Feb. 2005, pp. 112-113.
Platt, C.L. et al., "A New Resonator Design for Smith-Purcell Free Electron Lasers," 6Q19, p. 296.
Potylitsin, A.P., "Resonant Diffraction Radiation and Smith-Purcell Effect," (Abstract), arXiv: physics/9803043 v2 Apr. 13, 1998.
Potylitsyn, A.P., "Resonant Diffraction Radiation and Smith-Purcell Effect," Physics Letters A, Feb. 2, 1998, pp. 112-116, A 238, Elsevier Science B.V.
S. Hoogland et al., "A solution-processed 1.53 μm quantum dot laser with temperature-invariant emission wavelength," Optics Express, vol. 14, No. 8, Apr. 17, 2006, pp. 3273-3281.
S.M. Sze, "Semiconductor Devices Physics and Technology", 2nd Edition, Chapters 9 and 12, Copyright 1985, 2002.
Sadwick, Larry et al., "Microfabricated next-generation millimeter-wave power amplifiers," www.rfdesign.com.
Saraph, Girish P. et al., "Design of a Single-Stage Depressed Collector for High-Power, Pulsed Gyroklystrom Amplifiers," IEEE Transactions on Electron Devices, vol. 45, No. 4, Apr. 1998, pp. 986-990.
Sartori, Gabriele, "CMOS Photonics Platform," Luxtera, Inc., Nov. 2005, 19 pages.
Savilov, Andrey V., "Stimulated Wave Scattering in the Smith-Purcell FEL," IEEE Transactions on Plasma Science, Oct. 2001, pp. 820-823, vol. 29 No. 5, IEEE.
Schachter, Levi et al., "Smith-Purcell Oscillator in an Exponential Gain Regime," Journal of Applied Physics, Apr. 15, 1989, pp. 3267-3269, vol. 65 No. 8, American Institute of Physics.
Schachter, Levi, "Influence of the Guiding Magnetic Field on the Performance of a Smith-Purcell Amplifier Operating in the Weak Compton Regime," Journal of the Optical Society of America, May 1990, pp. 873-876, vol. 7 No. 5, Optical Society of America.
Schachter, Levi, "The Influence of the Guided Magnetic Field on the Performance of a Smith-Purcell Amplifier Operating in the Strong Compton Regime," Journal of Applied Physics, Apr. 15, 1990, pp. 3582-3592, vol. 67 No. 8, American Institute of Physics.
Search Report and Writen Opinion mailed Jul. 14, 2008 in PCT Appln. No. PCT/US2006/022773.
Search Report and Written Opinion mailed Apr. 23, 2008 in PCT Appln. No. PCT/US2006/022678.
Search Report and Written Opinion mailed Apr. 3, 2008 in PCT Appln. No. PCT/US2006/027429.
Search Report and Written Opinion mailed Aug. 19, 2008 in PCT Appln. No. PCT/US2007/008363.
Search Report and Written Opinion mailed Aug. 24, 2007 in PCT Appln. No. PCT/US2006/022768.
Search Report and Written Opinion mailed Aug. 31, 2007 in PCT Appln. No. PCT/US2006/022680.
Search Report and Written Opinion mailed Dec. 20, 2007 in PCT Appln. No. PCT/US2006/022771.
Search Report and Written Opinion mailed Feb. 12, 2007 in PCT Appln. No. PCT/US2006/022682.
Search Report and Written Opinion mailed Feb. 20, 2007 in PCT Appln. No. PCT/US2006/022676.
Search Report and Written Opinion mailed Feb. 20, 2007 in PCT Appln. No. PCT/US2006/022772.
Search Report and Written Opinion mailed Feb. 20, 2007 in PCT Appln. No. PCT/US2006/022780.
Search Report and Written Opinion mailed Feb. 21, 2007 in PCT Appln. No. PCT/US2006/022684.
Search Report and Written Opinion mailed Jan. 17, 2007 in PCT Appln. No. PCT/US2006/022777.
Search Report and Written Opinion mailed Jan. 23, 2007 in PCT Appln. No. PCT/US2006/022781.
Search Report and Written Opinion mailed Jan. 31, 2008 in PCT Appln. No. PCT/US2006/027427.
Search Report and Written Opinion mailed Jan. 8, 2008 in PCT Appln. No. PCT/US2006/028741.
Search Report and Written Opinion mailed Jul. 16, 2007 in PCT Appln. No. PCT/US2006/022774.
Search Report and Written Opinion mailed Jul. 16, 2008 in PCT Appln. No. PCT/US2006/022766.
Search Report and Written Opinion mailed Jul. 20, 2007 in PCT Appln. No. PCT/US2006/024216.
Search Report and Written Opinion mailed Jul. 26, 2007 in PCT Appln. No. PCT/US2006/022776.
Search Report and Written Opinion mailed Jul. 28, 2008 in PCT Appln. No. PCT/US2006/022782.
Search Report and Written Opinion mailed Jul. 3, 2008 in PCT Appln. No. PCT/US2006/022690.
Search Report and Written Opinion mailed Jul. 3, 2008 in PCT Appln. No. PCT/US2006/022778.
Search Report and Written Opinion mailed Jul. 7, 2008 in PCT Appln. No. PCT/US2006/022686.
Search Report and Written Opinion mailed Jul. 7, 2008 in PCT Appln. No. PCT/US2006/022785.
Search Report and Written Opinion mailed Jun. 18, 2008 in PCT Appln. No. PCT/US2006/027430.
Search Report and Written Opinion mailed Jun. 20, 2007 in PCT Appln. No. PCT/US2006/022779.
Search Report and Written Opinion mailed Jun. 3, 2008 in PCT Appln. No. PCT/US2006/022783.
Search Report and Written Opinion mailed Mar. 11, 2008 in PCT Appln. No. PCT/US2006/022679.
Search Report and Written Opinion mailed Mar. 24, 2008 in PCT Appln. No. PCT/US2006/022677.
Search Report and Written Opinion mailed Mar. 24, 2008 in PCT Appln. No. PCT/US2006/022784.
Search Report and Written Opinion mailed Mar. 7, 2007 in PCT Appln. No. PCT/US2006/022775.
Search Report and Written Opinion mailed May 2, 2008 in PCT Appln. No. PCT/US2006/023280.
Search Report and Written Opinion mailed May 21, 2008 in PCT Appln. No. PCT/US2006/023279.
Search Report and Written Opinion mailed May 22, 2008 in PCT Appln. No. PCT/US2006/022685.
Search Report and Written Opinion mailed Oct. 25, 2007 in PCT Appln. No. PCT/US2006/022687.
Search Report and Written Opinion mailed Oct. 26, 2007 in PCT Appln. No. PCT/US2006/022675.
Search Report and Written Opinion mailed Sep. 12, 2007 in PCT Appln. No. PCT/US2006/022767.
Search Report and Written Opinion mailed Sep. 13, 2007 in PCT Appln. No. PCT/US2006/024217.
Search Report and Written Opinion mailed Sep. 17, 2007 in PCT Appln. No. PCT/US2006/022689.
Search Report and Written Opinion mailed Sep. 17, 2007 in PCT Appln. No. PCT/US2006/022787.
Search Report and Written Opinion mailed Sep. 2, 2008 in PCT Appln. No. PCT/US2006/022769.
Search Report and Written Opinion mailed Sep. 21, 2007 in PCT Appln. No. PCT/US2006/022688.
Search Report and Written Opinion mailed Sep. 25, 2007 in PCT appln. No. PCT/US2006/022681.
Search Report and Written Opinion mailed Sep. 26, 2007 in PCT Appln. No. PCT/US2006/024218.
Search Report and Written Opinion mailed Sep. 26, 2008 in PCT Appln. No. PCT/US2007/00053.
Search Report and Written Opinion mailed Sep. 3, 2008 in PCT Appln. No. PCT/US2006/022770.
Search Report and Written Opinion mailed Sep. 5, 2007 in PCT Appln. No. PCT/US2006/027428.
Shih, I. et al., "Experimental Investigations of Smith-Purcell Radiation," Journal of the Optical Society of America, Mar. 1990, pp. 351-356, vol. 7, No. 3, Optical Society of America.
Shih, I. et al., "Measurements of Smith-Purcell Radiation," Journal of the Optical Society of America, Mar. 1990, pp. 345-350, vol. 7 No. 3, Optical Society of America.
Speller et al., "A Low-Noise MEMS Accelerometer for Unattended Ground Sensor Applications", Applied MEMS Inc., 12200 Parc Crest, Stafford, TX, USA 77477.

Swartz, J.C. et al., "THz-FIR Grating Coupled Radiation Source," Plasma Science, 1998. 1D02, p. 126.
Temkin, Richard, "Scanning with Ease Through the Far Infrared," Science, New Series, May 8, 1998, p. 854, vol. 280, No. 5365, American Association for the Advancement of Science.
Thumm, Manfred, "Historical German Contributions to Physics and Applications of Electromagnetic Oscillations and Waves.".
Thurn-Albrecht et al., "Ultrahigh-Density Nanowire Arrays Grown in Self-Assembled Diblock Copolymer Templates", Science 290. 5499, Dec. 15, 2000, pp. 2126-2129.
U.S. Appl. No. 11/203,407—Nov. 13, 2008 PTO Office Action.
U.S. Appl. No. 11/238,991—Dec. 6, 2006 PTO Office Action.
U.S. Appl. No. 11/238,991—Jun. 6, 2007 Response to PTO Office Action of Dec. 6, 2006.
U.S. Appl. No. 11/238,991—Sep. 10, 2007 PTO Office Action.
U.S. Appl. No. 11/238,991—Mar. 6, 2008 Response to PTO Office Action of Sep. 10, 2007.
U.S. Appl. No. 11/238,991—Jun. 27, 2008 PTO Office Action.
U.S. Appl. No. 11/238,991—Dec. 29, 2008 Response to PTO Office Action of Jun. 27, 2008.
U.S. Appl. No. 11/238,991—Mar. 24, 2009 PTO Office Action.
U.S. Appl. No. 11/243,477—Apr. 25, 2008 PTO Office Action.
U.S. Appl. No. 11/243,477—Oct. 24, 2008 Response to PTO Office Action of Apr. 25, 2008.
U.S. Appl. No. 11/243,477—Jan. 7, 2009 PTO Office Action.
U.S. Appl. No. 11/325,448—Jun. 16, 2008 PTO Office Action.
U.S. Appl. No. 11/325,448—Dec. 16, 2008 Response to PTO Office Action of Jun. 16, 2008.
U.S. Appl. No. 11/325,534—Jun. 11, 2008 PTO Office Action.
U.S. Appl. No. 11/325,534—Oct. 15, 2008 Response to PTO Office Action of Jun. 11, 2008.
U.S. Appl. No. 11/353,208—Jan. 15, 2008 PTO Office Action.
U.S. Appl. No. 11/353,208—Mar. 17, 2008 PTO Office Action.
U.S. Appl. No. 11/353,208—Sep. 15, 2008 Response to PTO Office Action of Mar. 17, 2008.
U.S. Appl. No. 11/353,208—Dec. 24, 2008 PTO Office Action.
U.S. Appl. No. 11/353,208—Dec. 30, 2008 Response to PTO Office Action of Dec. 24, 2008.
U.S. Appl. No. 11/400,280—Oct. 16, 2008 PTO Office Action.
U.S. Appl. No. 11/400,280—Oct. 24, 2008 Response to PTO Office Action of Oct. 16, 2008.
U.S. Appl. No. 11/410,905—Sep. 26, 2008 PTO Office Action.
U.S. Appl. No. 11/410,905—Mar. 26, 2009 Response to PTO Office Action of Sep. 26, 2008.
U.S. Appl. No. 11/410,924—Mar. 6, 2009 PTO Office Action.
U.S. Appl. No. 11/411,120—Mar. 19, 2009 PTO Office Action.
U.S. Appl. No. 11/411,129—Jan. 16, 2009 Office Action.
U.S. Appl. No. 11/411,130—May 1, 2008 PTO Office Action.
U.S. Appl. No. 11/411,130—Oct. 29, 2008 Response to PTO Office Action of May 1, 2008.
U.S. Appl. No. 11/417,129—Jul. 11, 2007 PTO Office Action.
U.S. Appl. No. 11/417,129—Dec. 17, 2007 Response to PTO Office Action of Jul. 11, 2007.
U.S. Appl. No. 11/417,129—Dec. 20, 2007 Response to PTO Office Action of Jul. 11, 2007.
U.S. Appl. No. 11/417,129—Apr. 17, 2008 PTO Office Action.
U.S. Appl. No. 11/417,129—Jun. 19, 2008 Response to PTO Office Action of Apr. 17, 2008.
U.S. Appl. No. 11/418,079—Apr. 11, 2008 PTO Office Action.
U.S. Appl. No. 11/418,079—Oct. 7, 2008 Response to PTO Office Action of Apr. 11, 2008.
U.S. Appl. No. 11/418,079—Feb. 12, 2009 PTO Office Action.
U.S. Appl. No. 11/418,080—Mar. 18, 2009 PTO Office Action.
U.S. Appl. No. 11/418,082—Jan. 17, 2007 PTO Office Action.
U.S. Appl. No. 11/418,083—2008-06-20-2008 PTO Office Action.
U.S. Appl. No. 11/418,083—Dec. 18, 2008 Response to PTO Office Action of Jun. 20, 2008.
U.S. Appl. No. 11/418,084—Nov. 5, 2007 PTO Office Action.
U.S. Appl. No. 11/418,084—May 5, 2008 Response to PTO Office Action of Nov. 5, 2007.
U.S. Appl. No. 11/418,084—Aug. 19, 2008 PTO Office Action.
U.S. Appl. No. 11/418,084—Feb. 19, 2009 Response to PTO Office Action of Aug. 19, 2008.
U.S. Appl. No. 11/418,085—Aug. 10, 2007 PTO Office Action.
U.S. Appl. No. 11/418,085—Nov. 13, 2007 Response to PTO Office Action of Aug. 10, 2007.
U.S. Appl. No. 11/418,085—Feb. 12, 2008 PTO Office Action.
U.S. Appl. No. 11/418,085—Aug. 12, 2008 Response to PTO Office Action of Feb. 12, 2008.
U.S. Appl. No. 11/418,085—Sep. 16, 2008 PTO Office Action.
U.S. Appl. No. 11/418,085—Mar. 6, 2009 Response to PTO Office Action of Sep. 16, 2008.
U.S. Appl. No. 11/418,087—Dec. 29, 2006 Response to PTO Office Action of Dec. 4, 2006.
U.S. Appl. No. 11/418,087—Feb. 15, 2007 PTO Office Action.
U.S. Appl. No. 11/418,087—Mar. 6, 2007 Response to PTO Office Action of Feb. 15, 2007.
U.S. Appl. No. 11/418,088—Jun. 9, 2008 PTO Office Action.
U.S. Appl. No. 11/418,088—Dec. 8, 2008 Response to PTO Office Action of Jun. 9, 2008.
U.S. Appl. No. 11/418,089—Mar. 21, 2008 PTO Office Action.
U.S. Appl. No. 11/418,089—Jun. 23, 2008 Response to PTO Office Action of Mar. 21, 2008.
U.S. Appl. No. 11/418,089—Sep. 30, 2008 PTO Office Action.
U.S. Appl. No. 11/418,089—Mar. 30, 2009 Response to PTO Office Action of Sep. 30, 2008.
U.S. Appl. No. 11/418,091—Jul. 30, 2007 PTO Office Action.
U.S. Appl. No. 11/418,091—Nov. 27, 2007 Response to PTO Office Action of Jul. 30, 2007.
U.S. Appl. No. 11/418,091—Feb. 26, 2008 PTO Office Action.
U.S. Appl. No. 11/418,097—Jun. 2, 2008 PTO Office Action.
U.S. Appl. No. 11/418,097—Dec. 2, 2008 Response to PTO Office Action of Jun. 2, 2008.
U.S. Appl. No. 11/418,097—Feb. 18, 2009 PTO Office Action.
U.S. Appl. No. 11/418,099—Jun. 23, 2008 PTO Office Action.
U.S. Appl. No. 11/418,099—Dec. 23, 2008 Response to PTO Office Action of Jun. 23, 2008.
U.S. Appl. No. 11/418,100—Jan. 12, 2009 PTO Office Action.
U.S. Appl. No. 11/418,123—Apr. 25, 2008 PTO Office Action.
U.S. Appl. No. 11/418,123—Oct. 27, 2008 Response to PTO Office Action of Apr. 25, 2008.
U.S. Appl. No. 11/418,123—Jan. 26, 2009 PTO Office Action.
U.S. Appl. No. 11/418,124—Oct. 1, 2008 PTO Office Action.
U.S. Appl. No. 11/418,124—Feb. 2, 2009 Response to PTO Office Action of Oct. 1, 2008.
U.S. Appl. No. 11/418,124—Mar. 13, 2009 PTO Office Action.
U.S. Appl. No. 11/418,126—Oct. 12, 2006 PTO Office Action.
U.S. Appl. No. 11/418,126—Feb. 12, 2007 Response to PTO Office Action of Oct. 12, 2006 (Redacted).
U.S. Appl. No. 11/418,126—Jun. 6, 2007 PTO Office Action.
U.S. Appl. No. 11/418,126—Aug. 6, 2007 Response to PTO Office Action of Jun. 6, 2007.
U.S. Appl. No. 11/418,126—Nov. 2, 2007 PTO Office Action.
U.S. Appl. No. 11/418,126—Feb. 22, 2008 Response to PTO Office Action of Nov. 2, 2007.
U.S. Appl. No. 11/418,126—Jun. 10, 2008 PTO Office Action.
U.S. Appl. No. 11/418,127—Apr. 2, 2009 Office Action.
U.S. Appl. No. 11/418,128—Dec. 16, 2008 PTO Office Action.
U.S. Appl. No. 11/418,128—Dec. 31, 2008 Response to PTO Office Action of Dec. 16, 2008.
U.S. Appl. No. 11/418,128—Feb. 17, 2009 PTO Office Action.
U.S. Appl. No. 11/418,129—Dec. 16, 2008 Office Action.
U.S. Appl. No. 11/418,129—Dec. 31, 2008 Response to PTO Office Action of Dec. 16, 2008.
U.S. Appl. No. 11/418,244—Jul. 1, 2008 PTO Office Action.
U.S. Appl. No. 11/418,244—Nov. 11, 2008 Response to PTO Office Action of Jul. 1, 2008.
U.S. Appl. No. 11/418,263—Sep. 24, 2008 PTO Office Action.
U.S. Appl. No. 11/418,263—Dec. 24, 2008 Response to PTO Office Action of Sep. 24, 2008.
U.S. Appl. No. 11/418,263—Mar. 9, 2009 PTO Office Action.
U.S. Appl. No. 11/418,315—Mar. 31, 2008 PTO Office Action.
U.S. Appl. No. 11/418,318—Mar. 31, 2009 PTO Office Action.
U.S. Appl. No. 11/441,219—Jan. 7, 2009 PTO Office Action.
U.S. Appl. No. 11/522,929—Oct. 22, 2007 PTO Office Action.

U.S. Appl. No. 11/522,929—Feb. 21, 2008 Response to PTO Office Action of Oct. 22, 2007.
U.S. Appl. No. 11/641,678—Jul. 22, 2008 PTO Office Action.
U.S. Appl. No. 11/641,678—Jan. 22, 2009 Response to Office Action of Jul. 22, 2008.
U.S. Appl. No. 11/711,000—Mar. 6, 2009 PTO Office Action.
U.S. Appl. No. 11/716,552—Feb. 12, 2009 Response to PTO Office Action of Feb. 9, 2009.
U.S. Appl. No. 11/716,552—Jul. 3, 2008 PTO Office Action.
Walsh, J.E., et al., 1999. From website: http://www.ieee.org/organizations/pubs/newsletters/leos/feb99/hot2.htm.
Wentworth, Stuart M. et al., "Far-Infrared Composite Microbolometers," IEEE MTT-S Digest, 1990, pp. 1309-1310.
Whiteside, Andy et al., "Dramatic Power Savings using Depressed Collector IOT Transmitters in Digital and Analog Service."
Yamamoto, N. et al., "Photon Emission From Silver Particles Induced by a High-Energy Electron Beam," Physical Review B, Nov. 6, 2001, pp. 205419-1-205419-9, vol. 64, The American Physical Society.
Yokoo, K. et al., "Smith-Purcell Radiation at Optical Wavelength Using a Field-Emitter Array," Technical Digest of IVMC, 2003, pp. 77-78.
Zeng, Yuxiao et al., "Processing and encapsulation of silver patterns by using reactive ion etch and ammonia anneal," Materials Chemistry and Physics 66, 2000, pp. 77-82.
"Notice of Allowability" mailed on Jul. 2, 2009 in U.S. Appl. No. 11/410,905, filed Apr. 26, 2006.
"Notice of Allowability" mailed on Jun. 30, 2009 in U.S. Appl. No. 11/418,084, filed May 5, 2006.
B. B Loechel et al., "Fabrication of Magnetic Microstructures by Using Thick Layer Resists", Microelectronics Eng., vol. 21, pp. 463-466 (1993).
Magellan 8500 Scanner Product Reference Guide, PSC Inc., 2004, pp. 6-27-F18.
Magellan 9500 with SmartSentry Quick Reference Guide, PSC Inc., 2004.
Response to Non-Final Office Action submitted May 13, 2009 in U.S. Appl. No. 11/203,407.
U.S. Appl. No. 11/238,991—May 11, 2009 PTO Office Action.
U.S. Appl. No. 11/350,812—Apr. 17, 2009 Office Action.
U.S. Appl. No. 11/411,130—Jun. 23, 2009 PTO Office Action.
U.S. Appl. No. 11/418,096—Jun. 23, 2009 PTO Office Action.
U.S. Appl. No. 11/433,486—Jun. 19, 2009 PTO Office Action.
Bekefi et al., "Stimulated Raman Scattering by an Intense Relativistic Electron Beam Subjected to a Rippled Electron Field", Aug. 1979, J. Appl. Phys., 50(8), 5168-5164.
European Search Report mailed Nov. 2, 2009 (related to PCT/US2006/022782).
Gervasoni J.L. et al., "Plasmon Excitations in Cylindrical Wires by External Charged Particles," Physical Review B (Condensed Matter and Materials Physics) APS through AIP USA, vol. 68, No. 23, Dec. 15, 2003, pp. 235302-1, XP002548423, ISSN: 0163-1829.
Gervasoni, J.L., "Excitations of Bulk and Surface Plasmons in Solids and Nanostructures," Surface and Interface Analysis, Apr. 2006, John Wiley and Sons LTD GB, vol. 38, No. 4, Apr. 2006, pp. 583-586, XP002548422.
Kaplan et al.: "Extreme-Ultraviolet and X-ray Emission and Amplification by Nonrelativistic Electron Beams Traversing a Superlattice" Applied Physics Letters, AIP, American Institute of Physics, Melville, NY LNKD-DOI: 10.1063/1.94869, vol. 44, No. 7, Apr. 1, 1984, pp. 661-663, XP000706537 ISSN: 0003-6951.
Rich, Alan, "Shielding and Guarding, How to Exclude Interference-type noise," Analog Dialogue 17-1, 1983.
Smith et al. "Enhanced Diffraction from a Grating on the Surface of a Negative-Index Metamaterial," Physical Review Letters, vol. 93, No. 13, 2004.
Supplementary European Search Report mailed Jul. 2, 2010 in EP Appln. No. 06772832.9.
Supplementary European Search Report mailed Jul. 5, 2010 in EP Appln. No. 06772830.3.
U.S. Appl. No. 11/411,129—Jan. 28, 2010 PTO Office Action.
U.S. Appl. No. 11/418,079—Jan. 7, 2010 PTO Office Action.
U.S. Appl. No. 11/418,080—Jan. 5, 2010 PTO Office Action.
U.S. Appl. No. 11/418,086—Mar. 4, 2010 PTO Office Action.
U.S. Appl. No. 11/418,128—Nov. 24, 2009 PTO Office Action.
U.S. Appl. No. 11/418,263—Dec. 9, 2009 PTO Office Action.
U.S. Appl. No. 11/418,318—Jun. 11, 2010 PTO Office Action.
U.S. Appl. No. 11/418,365—Feb. 23, 2010 PTO Final Office Action.
U.S. Appl. No. 11/418,096—Aug. 20, 2010 PTO Office Action.
Extended European Search Report mailed Jun. 16, 2010 in EP Appln. No. 06844144.3.
Brau et al., "Tribute to John E Walsh", Nuclear Instruments and Methods in Physics Research Section A. Accelerators, Spectrometers, Detectors and Associated Equipment, vol. 475, Issues 1-3, Dec. 21, 2001, pp. xiii-xiv.
Kapp, et al., "Modification of a scanning electron microscope to produce Smith—Purcell radiation", Rev. Sci. Instrum. 75, 4732 (2004).
Scherer et al. "Photonic Crystals for Confining, Guiding, and Emitting Light", IEEE Transactions on Nanotechnology, vol. 1, No. 1, Mar. 2002, pp. 4-11.
U.S. Appl. No. 11/203,407—Jul. 17, 2009 PTO Office Action.
U.S. Appl. No. 11/418,089—Jul. 15, 2009 PTO Office Action.
U.S. Appl. No. 11/418,097—Sep. 16, 2009 PTO Office Action.
U.S. Appl. No. 11/418,123—Aug. 11, 2009 PTO Office Action.
U.S. Appl. No. 11/418,365—Jul. 23, 2009 PTO Office Action.
U.S. Appl. No. 11/441,240—Aug. 31, 2009 PTO Office Action.
Urata et al., "Superradiant Smith-Purcell Emission", Phys. Rev. Lett. 80, 516-519 (1998).
U.S. Appl. No. 11/418,079—Oct. 12, 2010 PTO Office Action.
U.S. Appl. No. 11/418,089—Oct. 1, 2010 PTO Office Action.
U.S. Appl. No. 11/418,318—Oct. 13, 2010 PTO Office Action.
U.S. Appl. No. 12/843,415—Oct. 13, 2010 PTO Office Action.
U.S. Appl. No. 11/325,571, filed Jul. 5, 2007, Jonathan Gorrell.
U.S. Appl. No. 11/350,812, filed Aug. 16, 2007, Jonathan Gorrell.
EP Appln. No. 06773727.0—Aug. 9, 2010 EPO Supplementary Search Report.
EP Appln. No. 06784751.7—Aug. 5, 2010 EPO Supplementary Search Report.
Extended European Search Report mailed Oct. 11, 2010 in EP Appln. No. 06772897.2.
U.S. Appl. No. 11/418,086—Nov. 19, 2010 PTO Office Action.
U.S. Appl. No. 11/418,365—Nov. 10, 2010 PTO Office Action.
U.S. Appl. No. 12/213,449—Nov. 24, 2010 PTO Office Action.
Whitford B. G.: "The reflex klystron as a microwave detector" Institute of Radio Engineers Transactions on Electron Devices USA, vol. ED-8, No. 2, Mar. 1, 1961, pp. 131-134, XP002590568.

* cited by examiner

MICROWAVE COUPLED EXCITATION OF SOLID STATE RESONANT ARRAYS

COPYRIGHT NOTICE

A portion of the disclosure of this patent document contains material which is subject to copyright or mask work protection. The copyright or mask work owner has no objection to the facsimile reproduction by anyone of the patent document or the patent disclosure, as it appears in the Patent and Trademark Office patent file or records, but otherwise reserves all copyright or mask work rights whatsoever.

CROSS-REFERENCE TO RELATED APPLICATIONS

The present invention is related to the following co-pending U.S. patent applications which are all commonly owned with the present application:

1. U.S. patent application Ser. No. 11/238,991, entitled "Ultra-Small Resonating Charged Particle Beam Modulator," filed Sep. 30, 2005;
2. U.S. patent application Ser. No. 10/917,511, entitled "Patterning Thin Metal Film by Dry Reactive Ion Etching," filed on Aug. 13, 2004;
3. U.S. application Ser. No. 11/203,407, entitled "Method Of Patterning Ultra-Small Structures," filed on Aug. 15, 2005;
4. U.S. application Ser. No. 11/243,476, entitled "Structures And Methods For Coupling Energy From An Electromagnetic Wave," filed on Oct. 5, 2005;
5. U.S. application Ser. No. 11/243,477, entitled "Electron beam induced resonance," filed on Oct. 5, 2005;
6. U.S. application Ser. No. 11/325,448, entitled "Selectable Frequency Light Emitter from Single Metal Layer," filed Jan. 5, 2006;
7. U.S. application Ser. No. 11/325,432, entitled, "Matrix Array Display," filed Jan. 5, 2006;
8. U.S. application Ser. No. 11/302,471, entitled "Coupled Nano-Resonating Energy Emitting Structures," filed Dec. 14, 2005;
9. U.S. application Ser. No. 11/325,571, entitled "Switching Micro-resonant Structures by Modulating a Beam of Charged Particles," filed Jan. 5, 2006;
10. U.S. application Ser. No. 11/325,534, entitled "Switching Microresonant Structures Using at Least One Director," filed Jan. 5, 2006;
11. U.S. application Ser. No. 11/350,812, entitled "Conductive Polymers for Electroplating," filed Feb. 10, 2006;
12. U.S. application Ser. No. 11/349,963, entitled "Method and Structure for Coupling Two Microcircuits," filed Feb. 9, 2006;
13. U.S. application Ser. No. 11/353,208, entitled "Electron Beam Induced Resonance," filed Feb. 14, 2006;
14. U.S. application Ser. No. 11/400,280, entitled "Resonant Detectors for Optical Signals," filed Apr. 10, 2006;
15. U.S. application Ser. No. 11/410,924, entitled "Selectable Frequency EMR Emitter," filed Apr. 26, 2006; and
16. U.S. application Ser. No. 11/411,129, entitled "Micro Free Electron Laser (FEL)," filed Apr. 26, 2006.

FIELD OF THE DISCLOSURE

This relates in general to an array of receivers that couple energy between electromagnetic radiation (typically, but not necessarily, optical radiation) and an excitation source.

INTRODUCTION

In the related applications described above, micro- and nano-resonant structures are described that react in now-predictable manners when an electron beam is passed in their proximity. Those structures can be formed into groups, or arrays, that allow energy from the electron beam to be converted into the energy of electromagnetic radiation (light) when the electron beam passes nearby. Alternatively, those structures can receive incident electromagnetic radiation (light) and alter a characteristic of the electron beam in a way that can be detected. When the electron beam passes near the structure, it excites synchronized oscillations of the electrons in the structure (surface Plasmon) and/or electrons in the beam. Those excitations can result in reemission of detectable photons as electromagnetic radiation (EMR). The ability to couple energy either into a charged particle beam from light and from a charged particle beam into light has many advantageous applications including, but not limited to, efficient light production, digital signal processing, and receiver array surveillance.

In one or more of the above-referenced prior applications, ultra-small resonant structures were described that have particular interactions upon an electron beam when light was made incident upon them. As shown in FIG. 5, a light receiver 10 can include ultra-small resonant structures 12, such as any one of the ultra-small resonant structures described in U.S. patent application Ser. Nos. 11/238,991; 11/243,476; 11/243,477; 11/325,448; 11/325,432; 11/302,471; 11/325,571; 11/325,534; 11/349,963; and/or 11/353,208 (each of which is identified more particularly above). The resonant structures can be manufactured in accordance with any of U.S. application Ser. Nos. 10/917,511; 11/350,812; or 11/203,407 (each of which is identified more particularly above) or in other ways. Their sizes and dimensions can be selected in accordance with the principles described in those applications and, for the sake of brevity, will not be repeated herein. The contents of the applications described above are assumed to be known to the reader.

In the example of FIG. 5, the receiver 10 includes cathode 20, anode 19, optional energy anode 23, ultra-small resonant structures 12, Faraday cup or other receiving electrode 14, electrode 24, and differential current detector 16.

When the receiver 10 is not being stimulated by encoded light 15, the cathode 20 produces an electron beam 13, which is steered and focused by anode 19 and accelerated by energy anode 23. The electron beam 13 is directed to pass close to but not touching one or more ultra-small resonant structures 12. In this sense, the beam needs to be only proximate enough to the ultra-small resonant structures 12 to invoke detectable electron beam modifications. After the anode 19, the electron beam 13 passes energy anode 23, which further accelerates the electrons in known fashion. When the resonant structures 12 are not receiving the encoded light 15, then the electron beam 13 passes by the resonant structures 12 with the structures 12 having no significant effect on the path of the electron beam 13. The electron beam 13 thus follows, in general, the path 13*b* and is received by a Faraday cup or other detector electrode 14.

When, however, the encoded light 15 is induced on the resonant structures 12, the encoded light 15 induces surface plasmons to resonate on the resonant structures 12. The ability of the encoded light 15 to induce the surface plasmons is described in one or more of the above applications and is not repeated herein. The electron beam 13 is impacted by the surface plasmon effect causing the electron beam to steer away from path 13*b* (into the Faraday cup) and into alternative path 13*a* or 13*c*, which can be detected by differential current detector 16.

As the term is used herein, the structures are considered ultra-small when they embody at least one dimension that is smaller than the wavelength of the electromagnetic radiation that they are detecting (in the case of FIG. 5, the wavelength of visible light). The ultra-small structures are employed in a vacuum environment. Methods of evacuating the environment where the beam 13 passes by the structures 12 can be selected from known evacuation methods.

With consideration to the solid state resonant arrays described in the related applications, it may be prudent in a wide range of applications to utilize coupled microwave energy as an excitation source. Currently, one proposed method for excitation is a hardwired/driven signal transmitted via electrically connected pads. Although this case has its applications under the conditions of low drive frequency and given that signal transmission/coupling can still excite the devices, there may be alternative applications that may not be optimized from this arrangement. For the benefit of increased coupling, it may be possible to incorporate a microwave antenna to provide energy coupling and excitation to the Solid State Resonant Arrays.

THE PRESENTLY PREFERRED EXEMPLARY EMBODIMENTS

Figure 1:
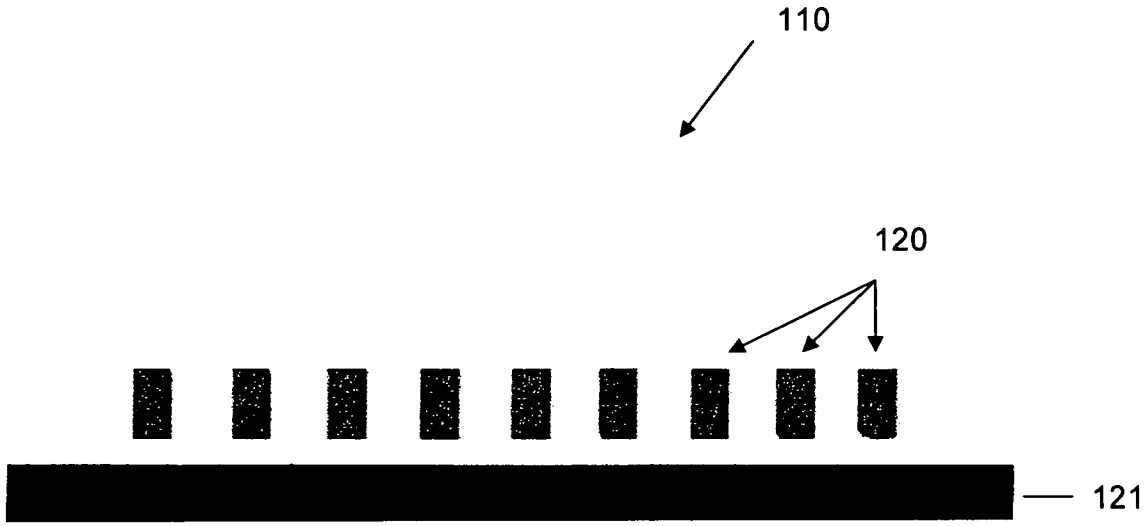
FIG. 1 is a simplified schematic view of a microwave strip antenna for use with Solid State Resonant Arrays.

The present systems detect microwave energy and convert it into optical (or other higher-than-optical frequency) energy. A simple microwave antenna for use with solid state resonant arrays is shown in FIG. 1. There, a strip antenna 110 includes a microwave antenna 121 of known type arranged near ultra-small resonant structures 120 of the solid state resonant array. In the manner described in the above-referenced applications, the ultra-small resonant structures are designed to emit electromagnetic radiation at a frequency higher than the microwave frequency using very small structures having a physical dimension less that the frequency of the emitted radiation. In the case of emitted optical radiation, the structures have a physical dimension less than the wavelength of the emitted light.

As the microwave antenna 121 is excited, an electromagnetic field profile based on the excitation signal is coupled and transmitted along the microwave antenna 121. The excitation signal can produce plasmon excitation on the ultra-small resonant structures 120 of the solid state resonant array, which based on their configuration, will emit their optical radiation at the designed wavelength.

Figure 2:
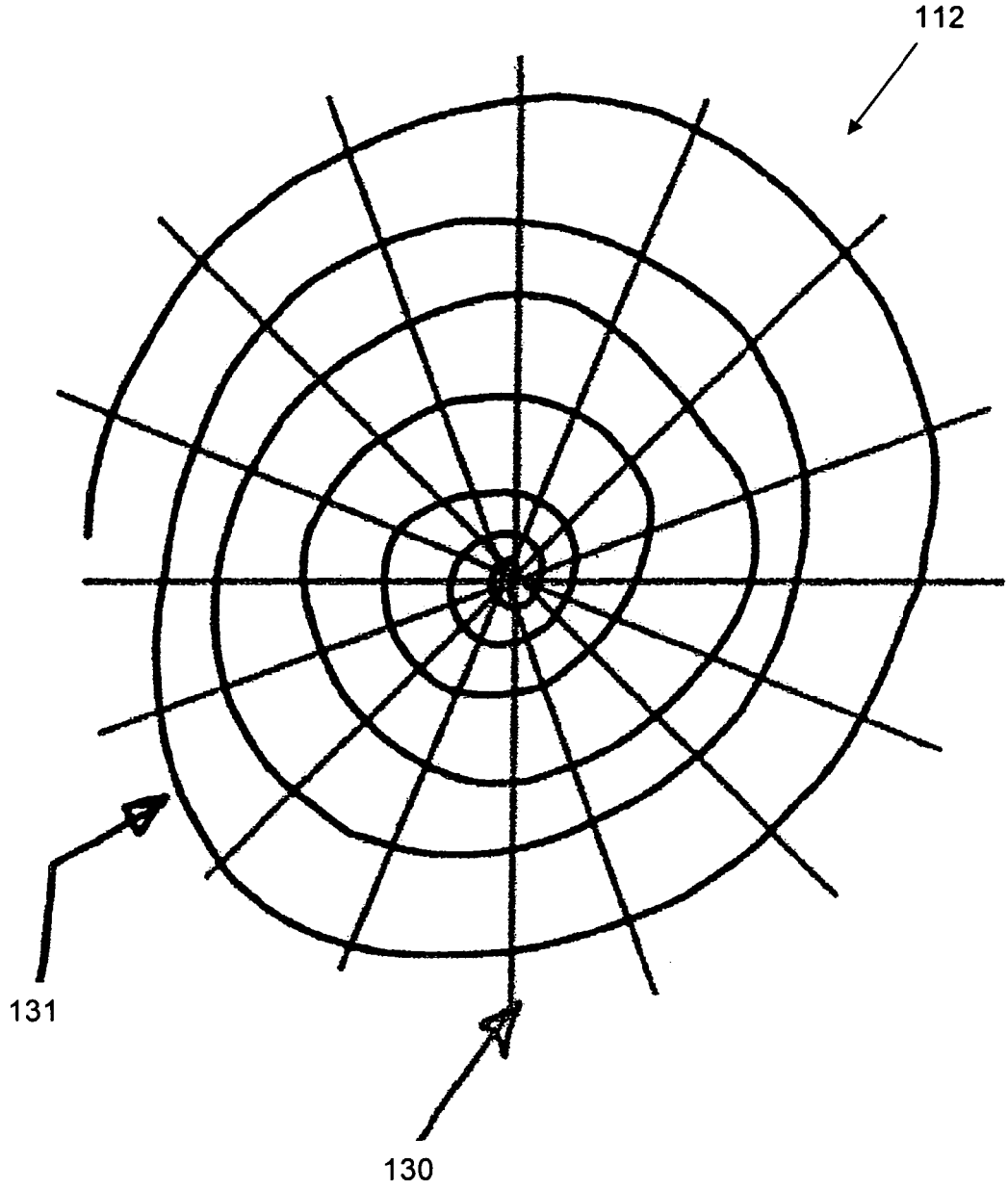
FIG. 2 is an alternative simplified schematic view of a microwave spiral antenna for use with Solid State Resonant Arrays.

Alternatively, the microwave antenna could be constructed in more elegant ways so as to excite many arrays at a time. One example is the spiral antenna 112 of FIG. 2. There, several lines of arrays 130 extend outwardly from a central point. The microwave antenna 131 spirals out from that central point beneath the lines of arrays 130.

Figure 3:
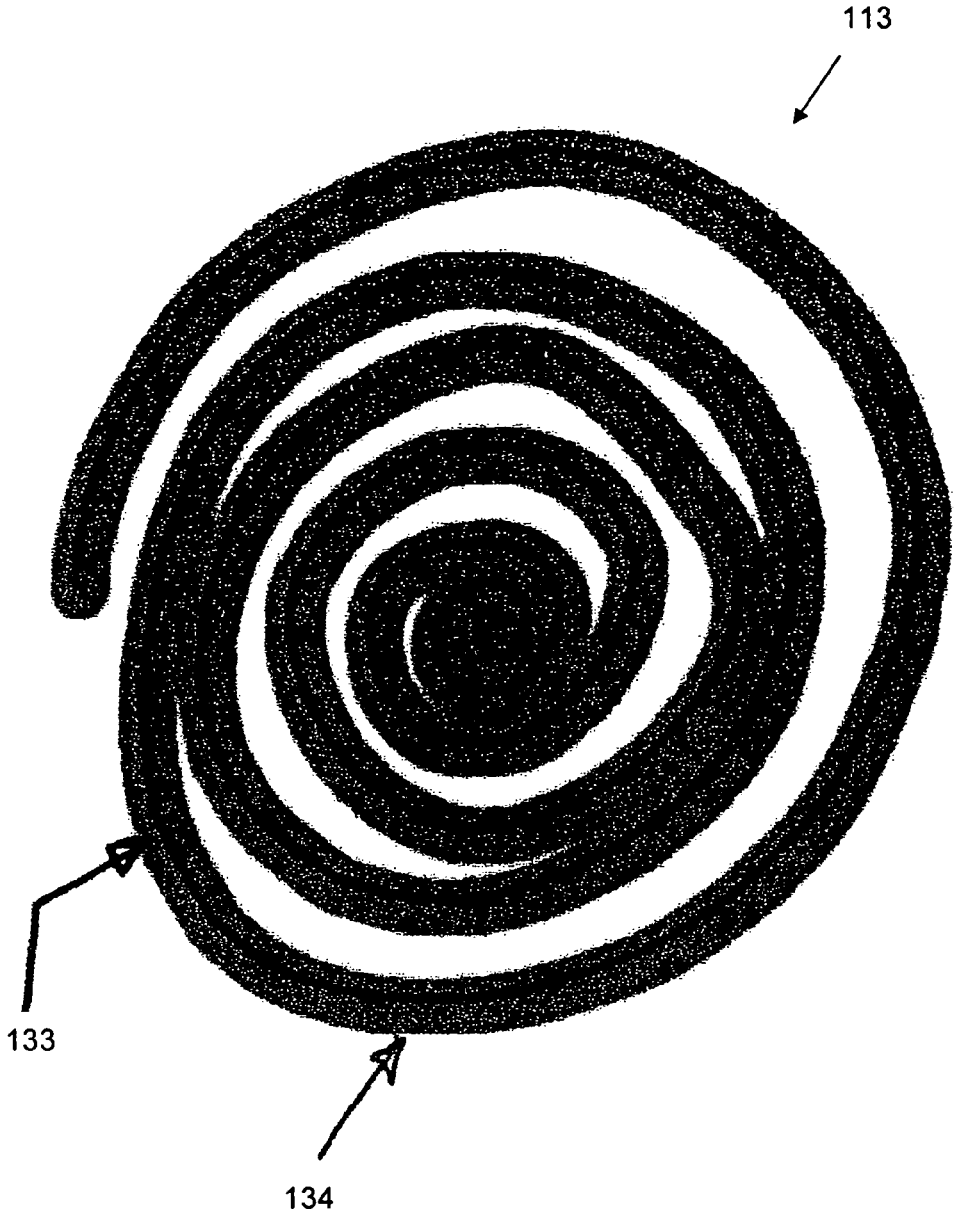
FIG. 3 is another alternative simplified schematic view of a microwave spiral antenna for use with Solid State Resonant Arrays.

Other variations on the array alignment and orientation are also of importance, and will be dependent on the application. Yet another example antenna 113 is shown in FIG. 3, in which the spiral-shaped microwave antenna 133 originates at the same central point, but the arrays are not formed in lines as in FIG. 2. Instead, the arrays 134 follow the path of the microwave antenna 133 to couple the microwave energy by their proximity to the edges of the antenna 133.

Figure 4:
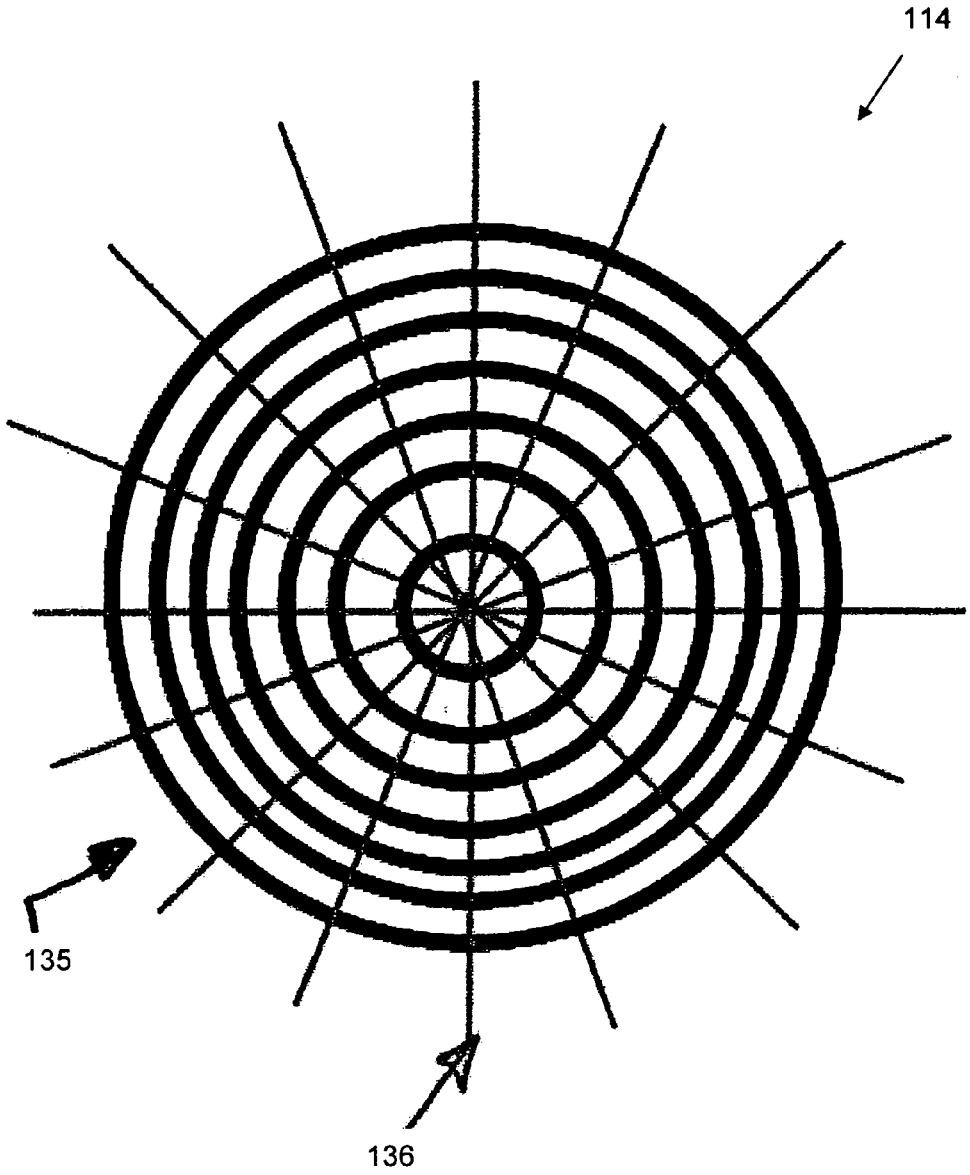
FIG. 4 is another alternative simplified schematic view of a microwave concentric circle antenna for use with Solid State Resonant Arrays.
Figure 5:
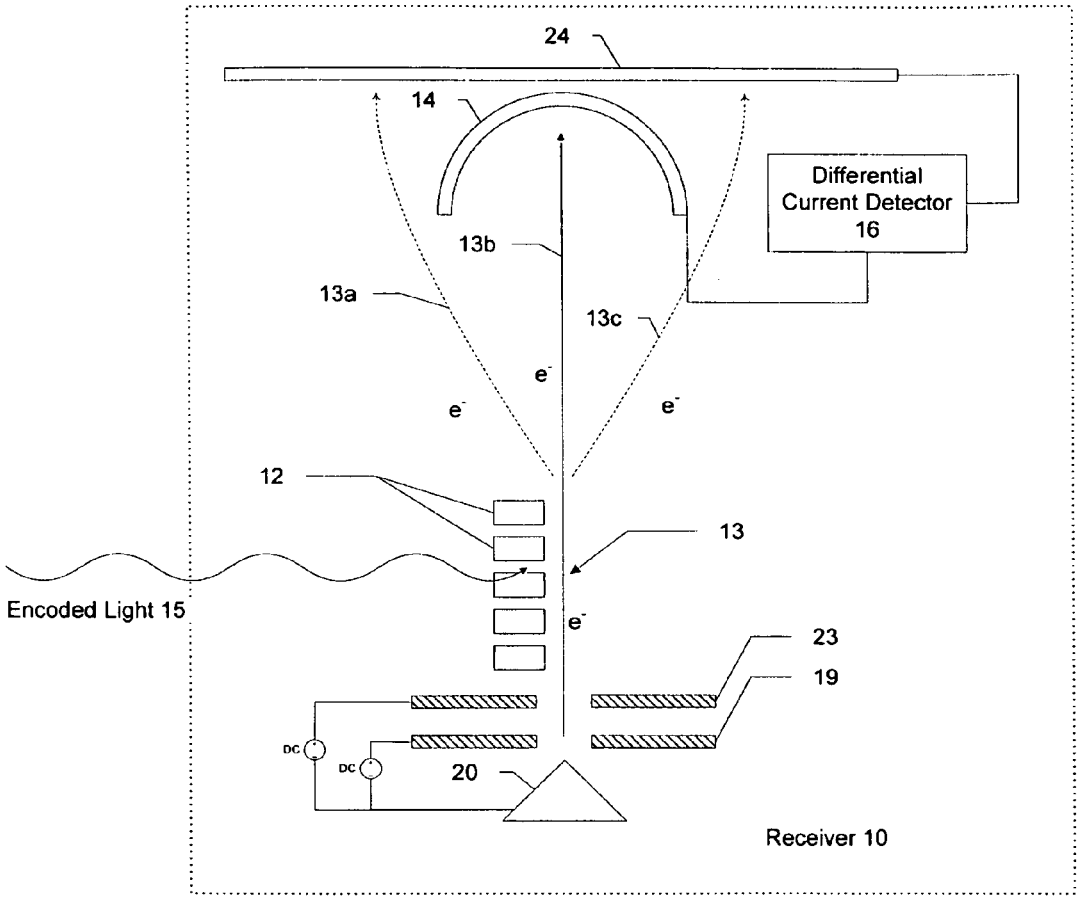
FIG. 5 is an example schematic of a charged particle beam antenna described in the related applications.

In addition to being used as a single wavelength resonant device, the detection device 114 of FIG. 4 represents a microwave antenna 135 that will couple a different frequency of microwave energy to a separate area of solid state resonant arrays 136. Thus, the size, length, arrangement and periodicity of the ultra-small resonant structures can be altered to tune different lines of the arrays 136 to different microwave frequencies. With a number of solid state resonant arrays 136 designed for a number of frequencies, essentially conversion of any microwave frequency to optical wavelength output is possible.

What is claimed is:

1. A receiver array to detect microwave radiation, comprising:

a microwave antenna; and an array of solid state resonant structures proximate to but not touching the microwave antenna to couple energy from the microwave antenna to the resonant structures to thereby produce resonant Plasmon activity on the surfaces of the resonant structures at a resonant frequency higher than the highest frequency in the microwave frequency range, the solid state resonant structures in the array being arranged in a path spaced apart from each other in a vacuum environment and having a physical dimension less than said wavelength of the resonant frequency higher than the microwave frequency.

2. The receiver according to claim 1 wherein the microwave antenna is in the form of a spiral.

3. The receiver according to claim 2 wherein the spiral defines a center and the array of solid state resonant structures proceeds outwardly from the center.

4. The receiver according to claim 2 wherein the spiral defines a center and the array of solid state resonant structures includes multiple lines of solid state resonant structures, wherein each line of solid state resonant structures proceeds outwardly from the center.

5. The receiver according to claim 2 wherein the array is arranged to trace at least a portion of the spiral.

6. The receiver according to claim 1 wherein the microwave antenna is in the form of concentric circles.

7. The receiver according to claim 6 wherein the concentric circles define a center and the array of solid state resonant structures includes multiple lines of solid state resonant structures, wherein each line of solid state resonant structures proceeds outwardly from the center.

8. The receiver according to claim 7 wherein each line of solid state resonant structures is tuned to a different microwave frequency.

9. The receiver according to claim 7 wherein at least two of the lines of solid state resonant structures are tuned to different microwave frequencies.

10. The receiver according to claim 1, wherein the resonant Plasmon activity on the surfaces of the resonant structures is synchronized oscillations of electrons on the surfaces of the resonant structures.

11. A system, comprising:

a microwave excitation source producing microwave energy;

a microwave antenna to receive the microwave energy; and an array of solid state resonant structures to couple the microwave energy from the microwave antenna to the resonant structures to thereby produce resonant Plasmon activity on the surfaces of the resonant structures at a resonant frequency higher than the highest frequency in the microwave frequency range, the solid state resonant structures in the array being arranged in a path spaced apart from each other in a vacuum environment and having a physical dimension less than said wavelength of the resonant frequency higher than the microwave frequency.

12. The receiver according to claim 11 wherein the microwave antenna is in the form of a spiral.

13. The receiver according to claim 12 wherein the spiral defines a center and the array of solid state resonant structures proceeds outwardly from the center.

14. The receiver according to claim 12 wherein the spiral defines a center and the array of solid state resonant structures includes multiple lines of solid state resonant structures, wherein each line of solid state resonant structures proceeds outwardly from the center.

15. The receiver according to claim 12 wherein the array is arranged to trace at least a portion of the spiral.

16. The receiver according to claim 11 wherein the microwave antenna is in the form of concentric circles.

17. The receiver according to claim 16 wherein the concentric circles define a center and the array of solid state resonant structures includes multiple lines of solid state resonant structures, wherein each line of solid state resonant structures proceeds outwardly from the center.

18. The receiver according to claim 17 wherein each line of solid state resonant structures is tuned to a different microwave frequency.

19. The receiver according to claim 17 wherein at least two of the lines of solid state resonant structures are tuned to different microwave frequencies.

20. The receiver according to claim 11, wherein the resonant Plasmon activity on the surfaces of the resonant structures is synchronized oscillations of electrons on the surfaces of the resonant structures.

* * * * *